US009458718B2

(12) United States Patent
Wright

(10) Patent No.: US 9,458,718 B2
(45) Date of Patent: Oct. 4, 2016

(54) AERATED ROCK DUST

(71) Applicant: Wright-Mix Material Solutions, LLC, Holden, WV (US)

(72) Inventor: Shannon N. Wright, Pikeville, KY (US)

(73) Assignee: Wright-Mix Material Solutions, LLC, Holden, WV (US)

( * ) Notice: Subject to any disclaimer, the term of this patent is extended or adjusted under 35 U.S.C. 154(b) by 286 days.

(21) Appl. No.: 14/211,166

(22) Filed: Mar. 14, 2014

(65) Prior Publication Data

US 2014/0265523 A1 Sep. 18, 2014

Related U.S. Application Data

(60) Provisional application No. 61/781,079, filed on Mar. 14, 2013.

(51) Int. Cl.

| | |
|---|---|
| ***B05C 1/16*** | (2006.01) |
| ***E01C 5/00*** | (2006.01) |
| ***E01C 11/24*** | (2006.01) |
| ***E21F 5/12*** | (2006.01) |

(52) U.S. Cl.
CPC ..... *E21F 5/12* (2013.01)

(58) Field of Classification Search
CPC ..... E21F 5/12; A62D 1/06; A62D 1/0014; A62D 1/0071
USPC ..... 427/136; 252/88.1
See application file for complete search history.

(56) References Cited

U.S. PATENT DOCUMENTS

| | | | | |
|---|---|---|---|---|
| 4,551,261 | A * | 11/1985 | Salihar | C09K 3/22 252/88.1 |
| 4,786,211 | A | 11/1988 | Leutner et al. | |
| 5,253,925 | A | 10/1993 | Modzik, Jr. | |
| 5,265,941 | A | 11/1993 | Marteney | |
| 5,273,344 | A | 12/1993 | Volkwein et al. | |
| 5,374,368 | A | 12/1994 | Hauschild | |
| 6,726,849 | B2 * | 4/2004 | Gay | A62D 1/0014 252/88.1 |
| 7,048,340 | B2 | 5/2006 | Lammer et al. | |
| 7,208,023 | B2 | 4/2007 | Reeves et al. | |
| 7,998,244 | B2 | 8/2011 | Skiles et al. | |
| 8,052,890 | B2 | 11/2011 | Nguyen | |
| 8,584,974 | B2 | 11/2013 | Masloff et al. | |
| 8,883,868 | B2 | 11/2014 | Masloff et al. | |
| 2004/0195545 | A1 | 10/2004 | Gay et al. | |
| 2010/0090160 | A1 | 4/2010 | Branning | |
| 2012/0111583 | A1 | 5/2012 | Brown et al. | |

OTHER PUBLICATIONS

Harris, M.L., et al., "Mitigating Coal Dust Explosions in Modern Underground Coal Mines," Mine Ventilation: Proceedings of the ninth International Mine Ventilation Congress, New Delhi, India, Nov. 10-13, 2009. Panigrahi DC, ed., New Delhi, India: Oxford & IBH Publishing Co. Pvt. Ltd., 2009, 1:143-149.

"Coal mining," From Wikipedia, the free encyclopedia, accessed Jun. 18, 2012 from http://en.wikipedia.org/wiki/Coal_mining, last modified on Jun. 2, 2012.

* cited by examiner

*Primary Examiner* — Michael Wieczorek
(74) *Attorney, Agent, or Firm* — Frost Brown Todd LLC

(57) ABSTRACT

This technology relates to a method of forming an aerated material for application to the surfaces of mines to minimize dust formation. The aerated material is comprised of rock dust and a foaming agent which is mixed with water, and when properly mixed and applied to a mine surface, creates a dry cellular structure with little caking.

11 Claims, 1 Drawing Sheet

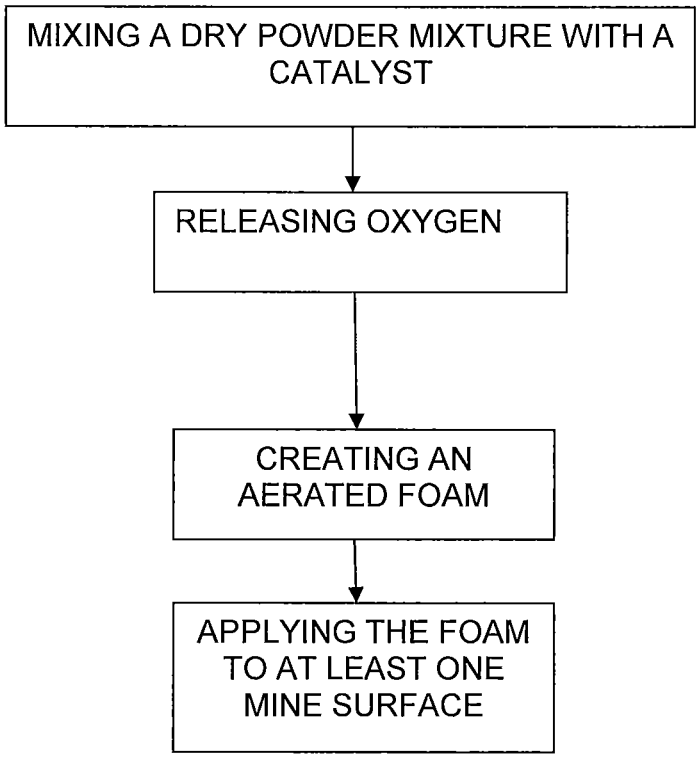
MIXING A DRY POWDER MIXTURE WITH A CATALYST
RELEASING OXYGEN
CREATING AN AERATED FOAM
APPLYING THE FOAM TO AT LEAST ONE MINE SURFACE

AERATED ROCK DUST

BACKGROUND

Coal dust present in coal mines generally found as is suspended in air, can be easily disturbed by mining and extraction operations. Once disturbed, a danger exists due to poor ventilation in coal mines and if an explosion were to occur, the suspended coal dust could act as a catalyst and as a conduit for fire resulting from the explosion, and allowing for the fire to spread more easily though the mine shafts. The suspended dust is deposited onto areas of the mine, such as the mine roof, the mine floors, and sidewalls of the mine known as ribs.

Rock dust has been utilized in the coal mining industry as a means to limit explosions these explosions in mines. Rock dust is typically an off-white solid, which is reflective against the black coal and renders the workable, coated area lighter than surrounding areas. Rock dust at a plus 80% non-combustible level provides a suitable material to be placed onto the mine roof, ribs, and floor. Rock dust is also required to meet certain requirements in the United States as set forth by 30 CFR §75.2 regulations that govern underground mining. For example, rock dust may be limestone rock dust.

Known dry rock dust application processes include, for example, application of particles such as calcium carbonate powder as rock dust. The calcium carbonate when exposed to heat from a flame is broken down into carbon dioxide, quenching the flame as described in U.S. Patent App. Publ. No. 2012/0111583 to Brown et al., entitled "Stone Dusting," published May 10, 2012, which is incorporated by reference herein. Known dry dusting processes, however, include a major limitation of interrupting production to apply the rock dust particles in mines. Known application processes of applying dry rock dust use a means of slinging or blowing rock dust onto surfaces in a manner that leads to quantities of dust escaping to contaminate downstream airways. Thus, mining paths are evacuated prior to a rock dust application to prevent contamination of downstream personnel and to prevent them from being affected by the dusting out of the mine. "Dusting out" is a term generally used by miners to describe such an event that occurs during the application of dry rock dust where the rock dust enters the air stream to a degrees that makes visibility poor and may cause breathing issues that are potential originators of diseases such as silicoses.

Wet rock dust application processes are known and eliminate the problem of contamination of downstream airways. To wet dust a mine, dry rock dust particles are mixed with a liquid such as water and released as a slurry onto mine surfaces. Under 30 CFR 75.2(d), however, wet rock-dusting of ribs and a mine roof does not elimination the need to dry rock-dust a mine floor. Further, when the slurry formed by wet rock dust dries out, the dried out slurry formed a hardened cake layer on a treated mine surface that is not as easily dispersed from the treated surfaces. Formation of such a hardened cake layer is referable to as caking, which is a term used by the Mine Safety and Health Administration ("MSHA") to explain the moisture content of rock dust that has been applied to an area that is at a level such that the rock dust is not effectively dispersible as the rock dust particles are bonded or caked together. Thus, dangerous dust deposits may escape from and through the caked rock dust during an event, such as an explosion, and not be protected by the rock dust as intended.

The present disclosure describes a dry dusting application utilizing aerated rock dust to provide a dispersible coating on mine surfaces that does not disrupt production when applied.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

FIG. 1 is flow chart diagram showing an exemplary process of the present disclosure.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

The present disclosure relates to a process for applying an aerated rock dust composition to mine walls and surfaces. As shown in FIG. 1, a dry powder mixture is mixed with a catalyst, such as water, which results in emission of oxygen. In embodiments, a pre-blended dry powder mixture, including rock dust and a foaming agent, which may be an anionic surfactant, passes through a mixing system. The foaming agent is mixed with a substance such as water, to cause the mixture to aerate and to release oxygen as it passes through the mixing system. The mixing process results in oxygen being released.

The aerated foam material may be applied to a mine surface. The aeration creates a material having a cellular structure where the mixture then expands the dimensions of the drying area to create a larger drying area than materials produced from known dry and wet application methods. The cellular structure of the resultant material may prevent caking when applied to mine surfaces (even if the surfaces are damp). Thus, the resultant cellular structure of the material allows for a dry product that has less caking when applied to a coal mine surface than known wet and dry methods for production of similar materials.

As discussed above and described in further detail below, the disclosed method includes adding water to the dry powder mixture to form an aerated material having an internal cellular structure and wherein oxygen gas produces the aeration and resulting cellular effect of the material. Other known methods have released less environmentally friendly non-oxygen gases such as carbon dioxide. Alternatively, other processes may release oxygen into an explosive environment. The disclosed process releases oxygen in a safe amount, as described below, and thus releases an environmentally friendly and safe substance.

One advantage of the subject matter of the present technology is that the method of dry dusting produces material having a cellular structure which also facilitates evaporation of any remaining water and causes the rock dust to dry out quickly while maintaining the cellular structure. In contrast, known wet dusting methods use water as a vehicle for the transportation of rock dust such that the rock dust is wet when applied to a mine surface in a generally small, thin coating. Wet slurry dusting is a process of creating a stone dust/water slurry and pumping it onto the mines walls roofs and ribs. The flow ability of the slurry needed to transport the mixed slurry through the pumping system should be very fluid. The fluidity of the slurry is typically between a 15-30 second efflux in accordance with ASTM C-939-10 Standard Test Method for Flow of Grout for Preplaced-Aggregate Concrete (Flow Cone Method). The density of the applied slurry is typically between 100 lbs/ft3-120 lbs/ft3. The fluidity coupled with the rock dust/water slurries heavy density do not allow the wet slurry to accumulate no more than a thin layer without running off the applied surfaces.

Wet slurry dusting contributes to the caking problem with rock dust applied as a wet slurry. When such rock dust comes in contact with water, the particles partly dissolve. As the slurry dries, the dissolved solution moves between the stone dust particles forming a bonding bridge that locks the particles together. This is referred to as "The Caking Effect". This caking reduces the amount of dust raised into suspension. Even at a less fluid consistency wet slurry rock dust cannot accumulate in thicker sections because the slurry is unable to adhere to the applied surface in thick sections. Generally, the slurry is too heavy to be applied in thick layers because the wet rock dust will not adhere to the applied surface.

The resultant cellular structure of the present disclosure "lifts" off of, and thus substantially disengages from, surfaces onto which it is applied during events that may be seismic, such as an explosion, while still maintaining a relatively and substantially rigid skeleton cellular structure that may easily be re-dusted over as needed.

The resultant cellular structure of the material of the present application may arise from a pre-blended dry powder mixture that is packaged in bags or sacks, such as in about 40 to about 50 pound bags or 2000 pound super sacks, for example, which may be mixed with water, to create an anionic surfactant based cellular foam material. The pre-blended dry powder may be transferred, for example, to a waterproof silo before mixing with water. The pre-blended dry powder mixture includes at least 94% rock dust. The pre-blended dry powder mixture additionally includes other dry products including, but not limited to, an anionic surfactant as the foaming agent. The pre-blended dry powder mixture may also include coated and/or uncoated sodium percarbonate particles and rapid-rise yeast. If coated, the sodium percarbonate particles would be coated by procedures known to one of ordinary skill in the art in view of the teachings herein. The anionic surfactant may include, for example, BASF Rheocell® Rheofill™, or Stepan Company BIO-TERGE® AS-40K or a similar dry powder product as will be apparent to one of ordinary skill in the art in view of the teachings herein. The anionic surfactant may be added in amounts of about 0.1% to about 0.5% of the dry weight of the rock dust.

The coated or uncoated sodium percarbonate particles include, for example, sodium percarbonate, an adduct of sodium carbonate and hydrogen peroxide (a perhydrate), with the formula $Na_2CO_3.1.5H_2O_2$. It is a colorless, crystalline, hydroscopic and water-soluble sodium percarbonate. It can be stabilized by treatment with an aqueous solution of an alkaline earth metal salt to form a thin layer of an alkaline earth metal carbonate on the surface. The resulting sodium percarbonate is improved with respect to its nonhydroscopic property while maintaining the same solubility in water and effective oxygen constant as initially intended. Such sodium percarbonate particles which may be used are disclosed in U.S. Pat. No. 5,374,368 to Hauschild, entitled "Stable Sodium Percarbonate Formulation," issued on Dec. 20, 1994, the disclosure of which is herein incorporated by reference.

The coated or uncoated sodium percarbonate particles are added and blended in amounts of about 1% to about 5% of the dry weight of the rock dust. As described above, the particles comprise sodium percarbonate ($Na_2CO_3.1.5H_2O_2$), which is a crystalline adduct of hydrogen peroxide ($H_2O_2$) with sodium carbonate (referable to as "ash soda"). The coated sodium percarbonate particles used in testing to create the aerated rock dust product are provided by Solvay Chemical OXYPER® sodium percarbonate. The coated sodium percarbonate particles consist of 85% sodium carbonate peroxyhydrate, approximately 13% sodium carbonate, and about 1.5% sodium silicate. As an alternative to sodium percarbonate particles, about 1.0% to about 1.9% of liquid $H_2O_2$ solution may be substituted to produce oxygen gas needed to form the anionic surfactant-based foam solution. The liquid $H_2O_2$ solution may be used at a dosage rate of about 28% to about 35% of the dry weight of the rock dust materials may be used in a manner as will be apparent to one of ordinary skill in the art in view of the teachings herein. Instead of using water ($H_2O$) to active dry powder package components including rock dust, sodium percarbonate particles, anionic surfactant powder, and rapid-rise yeast, for example, liquid $H_2O_2$ may be used as a substitute for water to be used with a dry powder solution that does not include sodium percarbonate particles (the dry powder solution including rock dust, anionic surfactant powder, and raid rise yeast) such that oxygen gas is still generated to produce foam.

The water content at the time of mixing to blend and properly activate the dry powder solution having sodium percarbonate particles may be, for example, between about 28% to about 35% of the dry powder solution. When liquid $H_2O_2$ is used, instead of water, with a dry powder solution that does not include sodium percarbonate particles, the liquid $H_2O_2$ may be a solution in the range of an about 1.0% to about 1.9% of the $H_2O_2$ content and about 98.1% to about 99% of the $H_2O_2$ solution is water. The liquid $H_2O_2$ solution may be added, similar to water, at a content that is added to a between 28% to 35% of the dry powder solution that does not include sodium percarbonate particles to achieve generally similar results as when water is used with a dry powder solution that does include sodium percarbonate particles.

Sodium percarbonate may be a source of $H_2O_2$. Larger amounts of $H_2O_2$ (exceeding 30%) may be introduced using sodium percarbonate as this can be handled more safely than a same concentration of $H_2O_2$. $H_2O_2$ is releasable from sodium percarbonate into even small quantities of water or into anhydrous solvents. To rapidly produce oxygen, water or rapid-rise yeast, either alone or in combination, may be used. The reaction that occurs with the addition of the catalyst, such as water, is described below.

The pre-blended dry powder mixture is feedable into a tanker that mixes the powder mix with a catalytic substance such as water and blows the powder in bulk. The catalytic substance may be potable water such that the water is drinkable, though other non potable sources may be used as will be apparent to one of ordinary skill in the art in view of the teachings here. A prescribed range of allowable water content is from about 28% to about 35% of the dry weight of the pre-blended powder mix. The density of a selected water source should not vary more than 5% from the density of a potable water source. In the examples below, the selected water source used was potable city water. Nonpotable water sources with questionable pH levels should be tested prior to use of those sources and monitored while in use to ensure desirable mixture characteristics. For example, pH level of water may affect the ability of surfactant modified products to produce stable foam. As a test of a selected nonpotable water source, the dry powder blend may be mixed with the selected nonpotable in accordance with ASTM C 305-12 Standard Practice for Mechanical Mixing of Hydraulic Cement Pastes and Mortars of Plastic Consistency in a manner as would be apparent to one of ordinary skill in the art in view of the teachings herein. After such mixed, the selected nonpotable water source is sufficient to use to create the aerate foam of the present disclosure if a density of the mixture is measured to be between about 40 lbs/ft3 and about 60 lbs/ft3. Further, the pH of the selected nonpotable water source should be comparable to typical potable water values that range between about pH of 6.5 to about pH of 8.5.

Through the addition of water, sodium percarbonate releases $H_2O_2$ according to the following reaction: $2Na_2CO_3.3H_2O_2 \rightarrow 2Na_2CO_3+3H_2O_2$. The $H_2O_2$ dissolves into water and oxygen. Using $H_2O_2$ as a gas forming foaming agent may create a cellular structure with many small, stable, and uniform in size air bubbles, enabling the aerated foam of the present technology to adhere well to an applied surface. This cellular structure may also enable the aerated foam to uniformly distribute dust upon the event of an explosion.

Catalytic decomposition of $H_2O_2$ from sodium percarbonate provides a source of oxygen and a source of hydroxyl radicals similar to decomposition of $H_2O_2$ from a water based solution. An alternative or in addition to the use of water is rapid-rise yeast, which may increase the rate of $H_2O_2$ output of sodium percarbonate particles while the addition of yeast speeds up the decomposition of $H_2O_2$ and the rate of $H_2O_2$ oxygen release. This, in turn, assists in generating the foaming action that is required to create the resultant cellular structure of the present disclosure.

A miner may then use a standard pump or an existing scatter dusting pump to mix a catalytic substance such as water with the dry powder mixture to form an anionic surfactant based, catalytic oxygenated gas forming foam that creates a resultant cellular structure of a mixed aerated rock dust. A mixing period may be, for example, between from about 30 seconds to about 60 seconds. The pump may then be used to apply the powder to large mine surface areas via means such as spraying, for example. A grout/mortar paddle mixture supplied with a pressure spray delivery system or a known scatter duster pump may alternatively be used. The resultant cellular structure may have a density in the range of about 40 pounds feet cubed to about 60 pounds feet cubed. The resultant cellular structure may have an air void content of approximately 50% to about 65% when tested in accordance with ASTM C185-08 Standard Test Method for Air Content of Hydraulic Cement Mortar or an equivalent method to check an air void content or foam content of the resultant cellular structure as will be apparent to one of ordinary skill in the art in view of the teachings herein. Such measurements as described above are indicative of a lack of adverse reactions and a structurally consistent creation of the resultant cellular structure.

After the mixed aerated rock dust is applied to a mine surface, the applied product may dry over a period of time. The mixed aerated rock dust, which is formed from an anionic surfactant based foam, produces oxygen rather than carbon dioxide or hydrogen gas as produced in other known foaming processes. Other known foaming processes do not form oxygen in mining applications where oxygen levels are regulated and where production of oxygen may produce a potent exothermic reaction that generates substantial amount of undesired heat in a mine. The oxygen produced by the present disclosure is produced in low to moderate levels that do not produce significant heat. After application of the product, an exothermic reaction slowly occurs to aid the drying process. After the catalytic reaction occurs to release all oxygen from the sodium percarbonate particles, the only by product left is ash soda, which is a substantially safe and environmentally friendly substance that is generally non-combustible and non-toxic.

EXAMPLES

Example 1

In a first example, a mixed aerated rock dust as described above had, before application, a typical density range of about 40 pounds feet cubed to about 60 pounds feet cubed and an air void content of between about 50% to about 65% when tested in accordance with ASTM C185-08 Standard Test Method for Air Content of Hydraulic Cement Mortar. Two types of approved U.S. Department of Labor rock dust were tested and compared. The first type of rock dust used is MineBrite™ from Marble Hill, Ga. This rock dust comprises pulverized limestone with a rating of 100% of dust falling through a #20 mesh (for example, for passes through a 20 square openings per square inch mesh) and a rating of about 75% to about 80% of dust falling through a #200 mesh (for example, for passes through a 200 square openings per square inch mesh). Testing for such particle size distribution may be done in accordance with ASTM C136-06 Standard Test Method for Sieve Analysis of Fine and Coarse Aggregates as will be apparent to one of ordinary skill in the art in view of the teachings herein. The combustible matter was at 0%, free and combined silica at about 2%, and the moisture content was at about 0.2%. The second type of rock dust used was from Boonesboro Quarry of The Allen Company, Inc. in Boonesboro, Ky. The second type of rock dust comprised pulverized limestone with a rating of 100% of dust falling through a #20 mesh (for example, for passes through a 20 square openings per square inch mesh) and a rating of about 72% to about 75% of dust falling through a #200 mesh (for example, for passes through a 200 square openings per square inch mesh). The combustible matter was at 0.3%, free and combined silica at about 2%, and the moisture content was at about 0.2%. Both products displayed substantially similar results after being tested for density, air void content, and the ability to dust with a light air blast after a short drying period.

For each tested rock dust type, three separate batches were produced at three different potable water contents of, respectively, 28%, 30%, and 35% of the dry powder mixture weight of the pre-blended materials. BASF, Rheocell®

Rheofill anionic surfactant was used at a dosage rate of 0.1%. Solvay Chemicals OXYPER® sodium percarbonate was used at a dosage rate of 2%. Fleischmanns™ Rapid Rise Yeast was used at a dosage rate of 0.2% and was blended with both types of rock dust tested, such each rock dust used comprised 97.7% of the mixture. The final mixed product for each respective rock dust tested is applied via spray onto a concrete wall. Each tested product adhered substantially well to wall surface in typical thickness ranges of about 0.25 inches to about 0.75 inches. After a short drying period, the applied products turned to dust with a light blast of air and did not visually appear to produce any caking. Density and air void contents were found to be within less than about a 2% variance between the two types of testing rock dust at the same water contents after the components were respectively blended and mixed in a paddle type mixer for each tested rock dust type, such mixing done in accordance with ASTM C 305-12 Standard Practice for Mechanical Mixing of Hydraulic Cement Pastes and Mortars of Plastic Consistency in a manner as would be apparently to one of ordinary skill in the art in view of the teachings herein.

Example 2

Similar to Example 1, a separate test was performed on the two approved types of rock dust, with the exception that a 1.5% concentration of liquid $H_2O_2$ was used to replace the effects of sodium percarbonate such that sodium percarbonate was not used in the dry powder mixture. The 1.5% concentration of liquid $H_2O_2$ with a dosage rate of 30% was mixed in a paddle mixer for about 30 to about 60 seconds with the pre-blended dry materials, which included BASF, Rheocell® Rheofill anionic surfactant used at a dosage rate of 0.1% and Fleischmanns™ Rapid Rise Yeast used at a dosage rate of 0.2%, the materials blended with both types of rock dust tested, such each rock dust used comprised 99.7% of the mixture. It was found that density and air void content were within less than about a 2% variance for both types of rock dust tested. A final mixed product for each type of rock dust was applied by spray to a concrete wall, to which surface the applied product adhered substantially well to with a thickness of from about 0.25 inches to about 0.75 inches. As with the first example, after a short drying period, the applied products turned to dust with a light blast of air and did not visually appear to produce any caking.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative. Accordingly, the scope of the present invention should be considered in terms of the following claims and is understood not to be limited to the details of structure and operation shown and described in the specification and drawings.

What is claimed is:

1. A method of a dry dusting a coal mine surface utilizing an aerated, oxygenated foam to provide a dispersible coating having a cellular structure, the method comprising:

a. providing an aerated foam comprising a dry powder mixture and a water catalyst, wherein the dry powder mixture comprises at least 94% rock dust and a dry foaming agent;

b. applying the aerated foam to a coal mine surface.

2. The method of claim 1, wherein the rock dust comprises limestone rock dust.

3. The method of claim 1 wherein the aerated foam has a density of from about 40 pounds per feet cubed to about 60 pounds per feet cubed.

4. The method of claim 3 wherein aerated foam has an air void content of from about 50% to about 65%.

5. The method of claim 1 wherein the dry foaming agent is an anionic surfactant which is present in an amount from about 0.1% to about 0.5% of the dry weight of the rock dust.

6. The method of claim 1 wherein the dry powder mixture additionally comprises coated or uncoated sodium percarbonate particles.

7. The method of claim 6 wherein the sodium percarbonate particles are added and blended into the dry powder mixture in amounts of about 1% to about 5% of the dry weight of the rock dust.

8. The method of claim 1 wherein the dry powder mixture additionally comprises yeast.

9. The method of claim 1 wherein the dry powder mixture additionally comprises about 1.0% to about 1.9% liquid $H_2O_2$ solution for production of oxygen gas for aeration.

10. A method of dry dusting coal mine surfaces comprising:

a. adding water to a dry powder mixture comprising rock dust, an anionic surfactant and sodium percarbonate;

b. mixing the water and dry powder mixture for about 30 seconds to about 60 seconds to from an oxygenated aerated foam;

c. applying the aerated foam to a mine surface to form a cellular coating onto said surface.

11. A method of dry dusting coal mine surfaces comprising:

a. adding a 1.5% concentration of liquid $H_2O_2$ to a dry powder mixture comprising rock dust, an anionic surfactant used at a dosage rate of 0.1% and yeast;

b. mixing the 1.5% concentration of liquid $H_2O_2$ and dry powder mixture for about 30 seconds to about 60 seconds to from an oxygenated aerated foam;

c. spraying the aerated foam to a mine surface to form a cellular coating onto said surface.

* * * * *